US009104124B2

(12) United States Patent
Hori et al.

(10) Patent No.: US 9,104,124 B2
(45) Date of Patent: Aug. 11, 2015

(54) ELECTROPHOTOGRAPHIC PHOTOSENSITIVE MEMBER, PROCESS CARTRIDGE, AND ELECTROPHOTOGRAPHIC APPARATUS

(75) Inventors: Maho Hori, Tokyo (JP); Kimihiro Yoshimura, Yokohama (JP); Yohei Miyauchi, Tokyo (JP); Kazuhisa Shirayama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/114,157

(22) PCT Filed: Apr. 23, 2012

(86) PCT No.: PCT/JP2012/061507

§ 371 (c)(1),
(2), (4) Date: Oct. 25, 2013

(87) PCT Pub. No.: WO2012/147982

PCT Pub. Date: Nov. 1, 2012

(65) Prior Publication Data

US 2014/0051018 A1 Feb. 20, 2014

(30) Foreign Application Priority Data

Apr. 27, 2011 (JP) ..... 2011-099696
Apr. 17, 2012 (JP) ..... 2012-094051

(51) Int. Cl.

| | |
|---|---|
| ***G03G 15/04*** | (2006.01) |
| ***G03G 15/00*** | (2006.01) |
| ***G03G 5/08*** | (2006.01) |
| ***G03G 5/05*** | (2006.01) |
| ***G03G 5/06*** | (2006.01) |
| ***G03G 5/147*** | (2006.01) |

(52) U.S. Cl.
CPC ..... *G03G 5/08* (2013.01); *G03G 5/0507* (2013.01); *G03G 5/0542* (2013.01); *G03G 5/0564* (2013.01); *G03G 5/0696* (2013.01); *G03G 5/14704* (2013.01); *G03G 5/14756* (2013.01)

(58) Field of Classification Search
CPC ..... G03G 5/08; G03G 5/147
USPC ..... 430/56, 66, 69; 399/111, 159
See application file for complete search history.

(56) References Cited

U.S. PATENT DOCUMENTS

2006/0133872 A1 * 6/2006 Sugiura et al. ..... 399/346

FOREIGN PATENT DOCUMENTS

| | | | |
|---|---|---|---|
| JP | 62-250460 | A | 10/1987 |
| JP | 5-158250 | A | 6/1993 |
| JP | 5-181299 | A | 7/1993 |
| JP | 8-262778 | A | 10/1996 |
| JP | 8-334939 | A | 12/1996 |
| JP | 2001-324826 | A | 11/2001 |
| JP | 2002-229301 | A | 8/2002 |
| JP | 2005-043765 | A | 2/2005 |
| WO | 20111016317 | A1 | 2/2011 |

* cited by examiner

*Primary Examiner* — Thorl Chea
(74) *Attorney, Agent, or Firm* — Canon U.S.A. Inc., IP Division

(57) ABSTRACT

The present invention relates to an electrophotographic photosensitive member including a support and a photosensitive layer formed on the support. The electrophotographic photosensitive member has a surface layer containing a polyarylate resin and acicular inorganic fillers. The acicular inorganic fillers are basic and have a number-average aspect ratio of 5 to 50 and a Mohs hardness of 2 to 6.

6 Claims, 3 Drawing Sheets

ELECTROPHOTOGRAPHIC PHOTOSENSITIVE MEMBER, PROCESS CARTRIDGE, AND ELECTROPHOTOGRAPHIC APPARATUS

TECHNICAL FIELD

The present invention relates to an electrophotographic photosensitive member, a process cartridge, and an electrophotographic apparatus.

BACKGROUND ART

In an electrophotographic photosensitive member containing an organic photoconductive material, a contact member (e.g., cleaning blade) is brought into contact with the surface of the electrophotographic photosensitive member. Consequently, it is required to reduce occurrence of image degradation due to the contact stress between the electrophotographic photosensitive member and the contact member, and it is also required to effectively reduce the friction force of the surface of the electrophotographic photosensitive member. Recently, in order to improve the durability of an electrophotographic photosensitive member, a resin having a high abrasion resistance is used as a thermoplastic resin contained in the surface layer of the electrophotographic photosensitive member. As a result, though the surface of the electrophotographic photosensitive member is hardly worn, discharge products generated by the charging process are hardly removed and thereby accumulate on the photosensitive member surface. The discharge products increase the friction force of the photosensitive member surface and also absorb moisture in the air under high humidity to reduce the surface resistance of the electrophotographic photosensitive member. This may cause image deletion.

As a method of reducing the friction force of an electrophotographic photosensitive member, particles or fillers having high lubricity are added to the surface layer of the electrophotographic photosensitive member. PTL 1 proposes a method of reducing the friction force between a photosensitive member and a contact member by adding fluorine resin particles to the surface layer. Alternatively, friction force can be reduced by using particles coated with a material having high lubricity. PTL 2 proposes a method of reducing the friction force between a photosensitive member and a contact member by adding silica particles having surfaces treated with a compound having a siloxane structure to the surface layer of an electrophotographic photosensitive member.

The abrasion resistance of an electrophotographic photosensitive member is also improved by adding acicular fillers of an inorganic material (hereinafter referred to as acicular inorganic fillers) to the surface layer of the electrophotographic photosensitive member. PTL 3 proposes a method of improving the abrasion resistance of a photosensitive member by adding acicular inorganic fillers of potassium titanate to the surface layer.

CITATION LIST

Patent Literature

PTL 1 Japanese Patent Laid-Open No. 2005-043765

PTL 2 Japanese Patent Laid-Open No. 8-262778

PTL 3 Japanese Patent Laid-Open No. 5-158250

SUMMARY OF INVENTION

Technical Problem

Unfortunately, investigation by the present inventors resulted in that though the methods described in PTLs 1 and 2 temporarily reduce friction force, discharge products accumulate in the process of forming images for a long period, and thereby the reduction in friction force becomes insufficient. Furthermore, since the removal of the discharge products is insufficient, image deletion cannot be sufficiently prevented under high temperature and high humidity environment.

In the method described in PTL 3, since the abrasion resistance of the polycarbonate resin is low, the acicular inorganic fillers are desorbed. As a result, scratches are made on the photosensitive member or the cleaning blade, and thereby image deletion cannot be sufficiently prevented.

Solution to Problem

The present invention provides an electrophotographic photosensitive member that can prevent image deletion and also can reduce friction force of the electrophotographic photosensitive member. The present invention also provides a process cartridge and an electrophotographic apparatus each having the electrophotographic photosensitive member. The present invention relates to the followings.

The present invention relates to an electrophotographic photosensitive member comprising:

a support; and a photosensitive layer formed on the support, wherein the electrophotographic photosensitive member has a surface layer comprising a thermoplastic resin and acicular inorganic fillers, wherein the thermoplastic resin is a polyarylate resin; and the acicular inorganic fillers are basic and have a number-average aspect ratio of 5 to 50; and each of the acicular inorganic fillers has Mohs hardness of 2 to 6.

The present invention relates to a process cartridge detachably attachable to a main body of an electrophotographic apparatus, wherein the process cartridge integrally supports the electrophotographic photosensitive member and a cleaning device.

The present invention relates to an electrophotographic apparatus comprising the electrophotographic photosensitive member, a charging device, an exposing device, a developing device, a transferring device, and a cleaning device.

Advantageous Effects of Invention

The present invention provides an electrophotographic photosensitive member having a surface layer containing a polyarylate resin and acicular inorganic fillers, where the electrophotographic photosensitive member can achieve both effects of preventing image deletion and of reducing friction force of the electrophotographic photosensitive member. The present invention provides a process cartridge and an electrophotographic apparatus each having the electrophotographic photosensitive member.

DESCRIPTION OF EMBODIMENT

Figure 1:
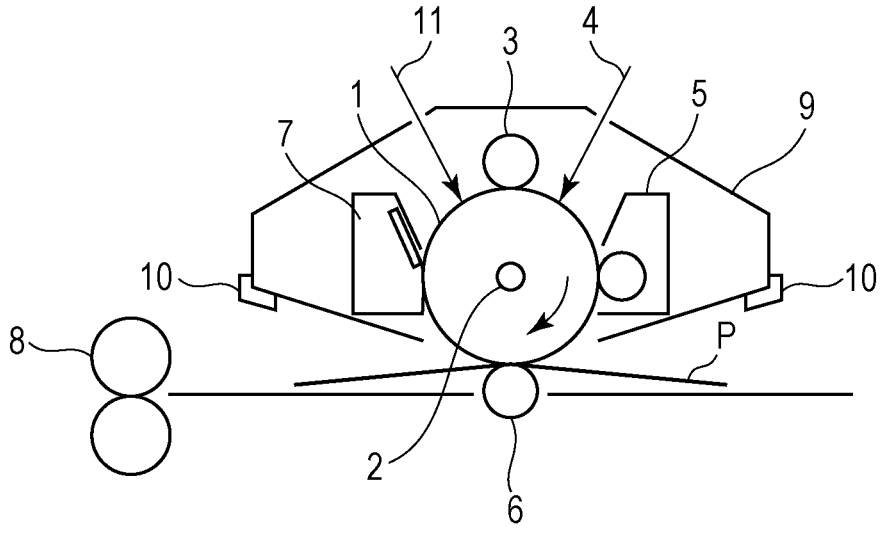
FIG. 1 is a diagram schematically illustrating an example of the structure of an electrophotographic apparatus having a process cartridge that includes an electrophotographic photosensitive member according to an aspect of the present invention.

The electrophotographic photosensitive member according to an aspect of the present invention is an electrophotographic photosensitive member including a support and a photosensitive layer disposed on the support and having a surface layer that contains a polyarylate resin as a thermoplastic resin and basic acicular inorganic fillers having a number-average aspect ratio of 5 to 50 and a Mohs hardness of 2 to 6 and being basic.

The present inventors presume the reasons for the excellent effects of inhibiting image deletion and of reducing friction force of the photosensitive member in the electrophotographic photosensitive member of the present invention as follows. The surface layer of the electrophotographic photosensitive member of the present invention contains a polyarylate resin as a thermoplastic resin. Though the polyarylate resin has a high density of aromatic rings in the main chain and thereby exhibits excellent abrasion resistance, the friction force of a photosensitive member readily increases by repeating use of the photosensitive member, and thereby image deletion tends to occur.

In the present invention, the surface layer further contains acicular inorganic fillers having an aspect ratio of 5 to 50. When the polyarylate resin and the acicular inorganic fillers in the surface layer are pressed by rubbing between the electrophotographic photosensitive member and the contact member, the fillers function as wedges and thereby are not separated from the polyarylate resin. Consequently, the acicular inorganic fillers are not removed to constantly maintain the uneven shape of the surface. This uneven shape of the photosensitive member surface reduces the contact area between the photosensitive member and the contact member to inhibit an increase in coefficient of friction. However, in a photosensitive member surface having an uneven shape, discharge products readily accumulate in the depressed portions of the photosensitive member surface, and thereby image deletion tends to occur.

However, the acicular inorganic fillers used in the present invention not only have an aspect ratio of 5 to 50 but also have a Mohs hardness of 2 to 6 and also are basic. Acicular inorganic fillers having such a relatively low Mohs hardness are adequately worn by the contact between the electrophotographic photosensitive member and the contact member, and thereby fine particles derived from the acicular inorganic fillers are supplied to the photosensitive member surface. In addition, since the acicular inorganic fillers are basic, the fine particles derived from the acicular inorganic fillers probably neutralize the discharge products accumulating in the depressed portions of the photosensitive member surface and remove the discharge products in the cleaning process.

It is believed as a result of these effects that image deletion can be prevented from occurring and also the effect of reducing friction force is maintained even in repeating use.

Meanwhile, in the case where a surface layer contains a hardening resin, since the abrasion resistance is very high, and thereby the acicular inorganic fillers are not exposed to the photosensitive member surface. Consequently, an uneven shape is not formed on the surface, and the effect of removing discharge products is insufficient, and thereby the effects of reducing the friction force of the electrophotographic photosensitive member and preventing image deletion are insufficient.

In the case where the thermoplastic resin is a polycarbonate resin of which raw material is a bivalent phenol, since the density of the aromatic rings in the main chain of the polycarbonate resin is lower than that of the polyarylate resin, the abrasion resistance of the polycarbonate resin is low. Consequently, the resin is worn to readily cause desorption of the acicular inorganic fillers. The desorbed acicular inorganic fillers and the worn polycarbonate resin forms scratches on the photosensitive member surface when the photosensitive member and the contact member are rubbed with each other, and thereby image deletion readily occurs.

The electrophotographic photosensitive member according to an aspect of the present invention is an electrophotographic photosensitive member having a support and a photosensitive layer disposed on the support.

The photosensitive member in the present invention is classified into a single-layer photosensitive layer where a charge-transporting material and a charge-generating material are contained in a single layer and a multi-layer (separated-function type) photosensitive layer that includes a charge-generating layer containing a charge-generating material and a charge-transporting layer containing a charge-transporting material. The electrophotographic photosensitive member of the present invention can be a multi-layer photosensitive layer from the viewpoint of electrophotographic characteristics. Furthermore, each of the charge-generating layer and the charge-transporting layer may have a multi-layer structure.

Figure 2:
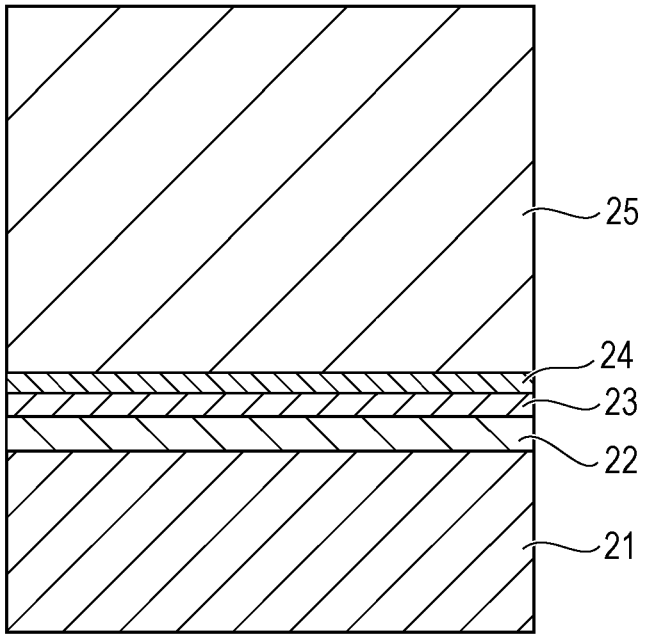
FIG. 2 is a diagram for describing a layer structure of an electrophotographic photosensitive member according to an aspect of the present invention.

FIG. 2 schematically illustrates a structure of the electrophotographic photosensitive member according to an aspect of the present invention. In the electrophotographic photosensitive member shown in FIG. 2, an electrically conductive layer 22 is stacked on a support 21, an intermediate layer 23 is stacked on the electrically conductive layer, a charge-generating layer 24 is stacked on the intermediate layer, and a charge-transporting layer 25 is stacked on the charge-generating layer. A protective layer may be optionally disposed on the charge-transporting layer. The charge-transporting layer may have a multi-layer structure.

In the case where the outermost layer is the charge-transporting layer, the charge-transporting layer is the surface layer of the electrophotographic photosensitive member of the present invention; and in the case where the protective layer is provided on the charge-transporting layer, the protective layer is the surface layer.

The polyarylate resin used in the electrophotographic photosensitive member of the present invention can have a polycondensation product of a bivalent phenol and phthalic acid as the basic structure from the viewpoint of abrasion resistance. Specifically, the polyarylate resin can have a weight-average molecular weight of 100000 to 250000 from the viewpoint of mechanical strength of the photosensitive member and has a structural unit represented by the following Formula (1):

[Chem. 1]

Formula (1)

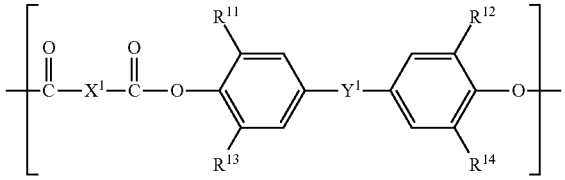

In Formula (1), $R^{11}$ to $R^{14}$ each independently represent a hydrogen atom or a methyl group; $X^1$ represents a meta-phenylene group, a para-phenylene group, or a bivalent group having two para-phenylene groups bonded with an oxygen atom; and $Y^1$ represents a single bond, a methylene group, an ethylidene group, a propylidene group, a cyclohexylidene group, or an oxygen atom. In particular, $Y^1$ can be a propylidene group.

Specific examples of the polyarylate resin in the present invention are shown below.

[Chem. 2]

(1-1)

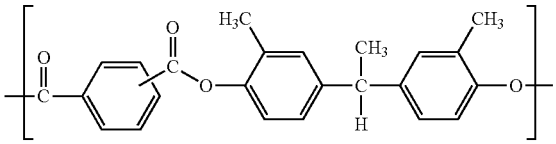

(1-2)

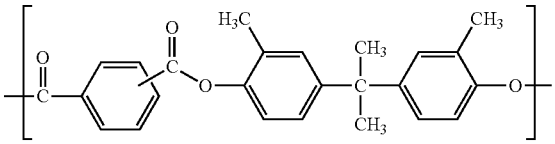

(1-3)

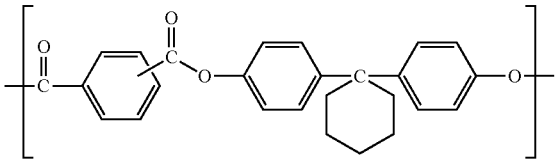

(1-4)

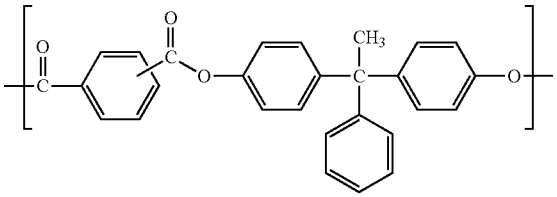

(1-5)

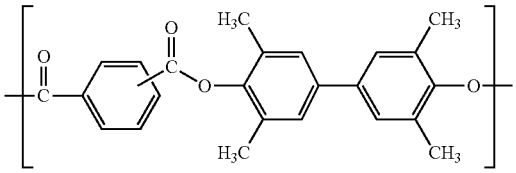

(1-6)

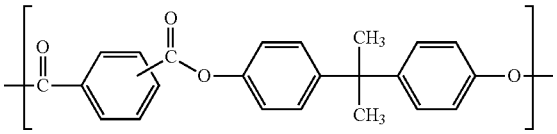

(1-7)

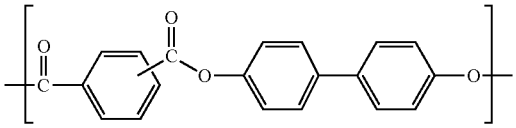

(1-8)

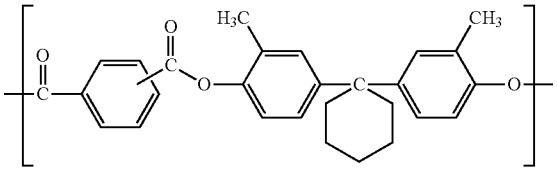

(1-9)

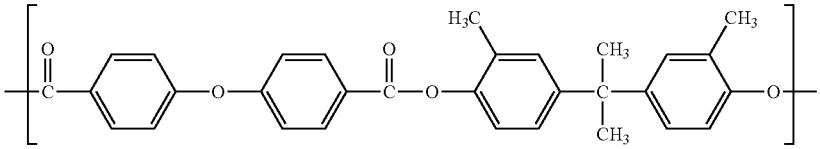

(1-10)

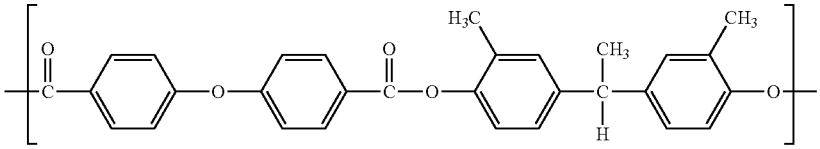

(1-11)

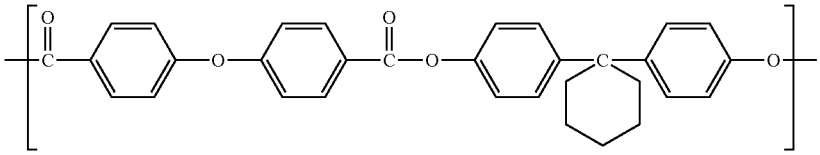

In the electrophotographic photosensitive member of the present invention where the surface layer is a charge-transporting layer, the charge-transporting layer may contain another resin in addition to the polyarylate resin. Examples of the resin mixed with the polyarylate resin include acrylic resins, polyester resins, and polycarbonate resins. The ratio of the polyarylate resin and another resin can be 9:1 to 99:1 (mass ratio).

In the electrophotographic photosensitive member of the present invention where the surface layer is a protective layer, the protective layer may contain another resin in addition to the polyarylate resin. Examples of the resin mixed with the polyarylate resin include acrylic resins, polyester resins, and polycarbonate resins. The ratio of the polyarylate resin and another resin can be 9:1 to 99:1 (mass ratio).

In the electrophotographic photosensitive member of the present invention, the acicular inorganic fillers contained in the surface layer can have a number-average aspect ratio of 5 to 50, more preferably 5 to 20.

The aspect ratio of acicular inorganic fillers is a ratio of the average fiber length to the average fiber diameter of the acicular inorganic fillers. The aspect ratio is measured using acicular inorganic fillers prepared by dissolving the surface layer of a produced photosensitive member in tetrahydrofuran. An average of aspect ratios of arbitrarily selected 100 acicular inorganic fillers is determined with an image processing apparatus (trade name: Luzex-FS, manufactured by Nireco Corporation). This average is used as the number-average aspect ratio. In a number-average aspect ratio of less than 5, the acicular inorganic fillers readily desorb from the surface layer of a photosensitive member, resulting in insufficient effects of preventing image deletion and of reducing the friction force of the photosensitive member. In the case of acicular inorganic fillers having an aspect ratio of higher than 50, the fillers tend to pass through the surface layer to accelerate hole injection from the support. The acicular inorganic fillers have an average fiber diameter of 0.1 to 5 micrometers and an average fiber length of 5 to 50 micrometers.

From the viewpoint of preventing occurrence of image deletion, each of the acicular inorganic fillers can have a Mohs hardness of 2 to 6, more preferably 2.5 to 5. If the Mohs hardness is lower than 2, acicular inorganic fillers readily desorb because of the too low Mohs hardness. As a result, fine particles derived from the acicular inorganic fillers are not supplied to the photosensitive member surface, and thereby the effect of preventing image deletion becomes insufficient. If the Mohs hardness is higher than 6, the acicular inorganic fillers are hardly worn because of the too high Mohs hardness. As a result, fine particles derived from the acicular inorganic fillers are not supplied to the photosensitive member surface, and thereby the effect of preventing image deletion becomes insufficient.

The Mohs hardness was devised by F. Mohs. A material is rubbed with the following ten standard materials, and when the material is scratched by any of the standard materials, the material is defined to have a hardness lower than the standard material. The standard materials are, from the lowest to the highest hardness, 1: talc, 2: gypsum, 3: calcite, 4: fluorite, 5: apatite, 6: orthoclase, 7: crystal, 8: topaz, 9: corundum, and 10: diamond. If the acicular inorganic fillers in the present invention have a hardness between that of two standard materials, for example, between calcite (Mohs hardness: 3) and fluorite (Mohs hardness: 4), the hardness is defined as 3.5. The Mohs hardness defines the degree of the hardness when stress is applied in the horizontal direction and is suitable for measuring wear of the acicular inorganic fillers that are rubbed with a cleaning blade. The Mohs hardness can be measured with a known Mohs scale of hardness.

The discharge product that causes image deletion is acid. The acicular inorganic fillers in the present invention have a characteristic of being basic, in addition to the above-described characteristics, and thereby image deletion can be prevented. It is presumed that the basic acicular inorganic fillers contained in the surface layer can neutralize the acidity of the discharge products and, thereby, occurrence of image deletion due to discharge products can be prevented. In the present invention, basic fillers are those of which dispersion has a pH of 8 or more, more preferably a pH of 9 to 11. The pH of a dispersion of acicular inorganic fillers is measured as follows: Five grams of acicular inorganic fillers are put in 100 mL of water, followed by boiling for 5 min. The dispersion is cooled to room temperature and is left to stand for 10 min. The pH of the supernatant of this dispersion is measured with a pH meter.

The acicular inorganic fillers are made of an inorganic material, and examples of the material include basic magnesium sulfate (trade name: MOS-HIGE, manufactured by Ube Industries, Ltd., chemical formula: $MgSO_4.5Mg(OH)_2.3H_2O$), potassium titanate (trade name: Tismo D, manufactured by Otsuka Chemical Co., Ltd., chemical formula: $K_2O.8TiO_2$), whisker (single crystal fiber) of natural calcium silicate (trade name: Wollastonite 4W, manufactured by Tomoe Engineering Co., Ltd., chemical formula: $CaO-SiO_2$), and sepiolite.

The content of the acicular inorganic fillers is 0.1% to 30% by volume based on the total volume of the surface layer of a photosensitive member at 27 degrees Celsius and under one atmospheric pressure. If the content is lower than 0.1% by volume, the effect of reducing the friction force of a photosensitive member may be insufficient. If the content is higher than 30% by volume, the electrophotographic characteristics may be insufficient.

The structure of an electrophotographic photosensitive member according to an aspect of the present invention will be described. The support used in the electrophotographic photosensitive member of the present invention can be electrically conductive (electrically conductive support), and examples of the electrically conductive material include aluminum, aluminum alloys, and stainless steel. As a support of aluminum or an aluminum alloy, for example, an ED tube, an EI tube, or a support prepared by treating them by cutting, electrolytic composite polishing, or wet or dry honing can be used. In addition, those where an electrically conductive thin film of aluminum, an aluminum alloy, or an indium oxide-tin oxide alloy is formed on a metal support or a resin support can be used. The surface of a support may be applied with cutting, roughing, or alumite treatment.

The material of the support may be a resin impregnated with electrically conductive particles such as carbon black, tin oxide particles, titanium oxide particles, or silver particles or plastic including an electrically conductive resin.

In order to prevent occurrence of interference fringes due to scattering of, for example, laser beams or to cover scratches of a support, an electrically conductive layer may be disposed between the support and the photosensitive layer (charge-generating layer, charge-transporting layer) or an intermediate layer described below.

In the electrophotographic photosensitive member of the present invention, an electrically conductive layer including electrically conductive particles and a resin may be disposed on the support. The electrically conductive layer is formed using an application solution for electrically conductive layer prepared by dispersing the electrically conductive particles in the resin. Examples of the electrically conductive particles include carbon black, acetylene black, metal powders of, for example, aluminum, nickel, iron, nichrome, copper, zinc, or silver, and metal oxide powders of, for example, electrically conductive zinc oxide or ITO.

Examples of the resin contained in the electrically conductive layer include polyester resins, polycarbonate resins, polyvinyl butyral resins, acrylic resins, silicone resins, epoxy resins, melamine resins, urethane resins, phenol resins, and alkyd resins.

The solvent for the application solution for the electrically conductive layer is, for example, an ether solvent, an alcohol solvent, a ketone solvent, or an aromatic hydrocarbon solvent. The electrically conductive layer can have a thickness of 0.2 to 40 micrometers, preferably 1 to 35 micrometers, more preferably 5 to 30 micrometers.

In the electrophotographic photosensitive member of the present invention, an intermediate layer may be disposed between the support or the electrically conductive layer and the charge-generating layer.

The intermediate layer can be formed by applying an application solution for intermediate layer containing a resin onto a support or an electrically conductive layer and drying or hardening it.

Examples of the resin contained in the intermediate layer include polyacrylic acids, methyl cellulose, ethyl cellulose, polyamide resins, polyolefin resins, polyimide resins, polyamideimide resins, polyamic acid, melamine resins, epoxy resins, and polyurethane resins.

The intermediate layer can have a thickness of 0.05 to 40 micrometers, preferably 0.1 to 30 micrometers. The intermediate layer may contain semiconductive particles, an electron-transporting material, or an electron-receiving material.

Charge-Generating Layer

In the electrophotographic photosensitive member of the present invention, a charge-generating layer is disposed on the support, the electrically conductive layer, or the intermediate layer.

Examples of the charge-generating material used in the electrophotographic photosensitive member of the present invention include azo pigments, phthalocyanine pigments, indigo pigments, and perylene pigments. These charge-generating materials may be used alone or in a combination of two or more thereof. Among them, oxytitanium phthalocyanine, hydroxygallium phthalocyanine, and chlorogallium phthalocyanine exhibit high sensitivity as charge-generating materials.

Examples of the resin contained in the charge-generating layer include polycarbonate resins, polyester resins, butyral resins, polyvinyl acetal resins, acrylic resins, vinyl acetate resins, and urea resins. For example, a butyral resin can be used, but the resins may be used alone, in a mixture, or as a copolymer or a copolymer of two or more.

The charge-generating layer can be formed by applying an application solution for charge-generating layer prepared by dispersing a charge-generating material together with a resin and a solvent and then drying it. The charge-generating layer may be an evaporated film of a charge-generating material.

The dispersing is performed by, for example, a method using a homogenizer, ultrasonic waves, a ball mill, a sand mill, an attritor, or a roll mill.

The ratio of the charge-generating material can be 0.1 to 10 parts by mass, preferably 0.25 to 4 parts by mass, based on 1 part by mass of the resin.

Examples of the solvent used in the application solution for the charge-generating layer include alcohol solvents, sulfoxide solvents, ketone solvents, ether solvents, ester solvents, and aromatic hydrocarbon solvents.

The charge-generating layer can have a thickness of 0.01 to 5 micrometers, preferably 0.1 to 2 micrometers. The charge-generating layer can optionally contain various additives such as a sensitizer, an antioxidant, an ultraviolet absorber, or a plasticizer. In order to prevent charges from stagnating in the charge-generating layer, the charge-generating layer may contain an electron-transporting material or an electron-receiving material.

Charge-Transporting Layer

In the electrophotographic photosensitive member of the present invention, a charge-transporting layer is disposed on the charge-generating layer.

The charge-transporting layer can be formed by applying an application solution for charge-transporting layer prepared by dispersing a charge-transporting material together with a resin and a solvent and then drying it.

In the present invention, in the case where the charge-transporting layer is the surface layer, the charge-transporting layer contains the polyarylate resin and the acicular inorganic fillers and may optionally another resin as described above. The resin that is optionally mixed is the same as those described above.

Examples of the charge-transporting material used in the electrophotographic photosensitive member of the present invention include triarylamine compounds, hydrazone compounds, styryl compounds, stilbene compounds, pyrazoline compounds, oxazole compounds, thiazole compounds, and triarylmethane compounds. These charge-transporting materials may be used alone or in a combination of two or more thereof.

The dispersing is performed by, for example, a method using a homogenizer, ultrasonic waves, a ball mill, a sand mill, an attritor, or a roll mill.

The ratio of the charge-transporting material can be 0.5 to 2 parts by mass based on 1 part by mass of the thermoplastic resin.

Examples of the solvent used in the application solution for the charge-transporting layer include ketone solvents, ester solvents, ether solvents, aromatic hydrocarbon solvents, and halogenated hydrocarbon solvents. These solvents may be used alone or in a combination of two or more.

The charge-transporting layer can have a thickness of 5 to 30 micrometers, preferably 6 to 25 micrometers. The charge-transporting layer can optionally contain various additives such as an antioxidant, an ultraviolet absorber, or a plasticizer.

In the electrophotographic photosensitive member of the present invention, a protective layer may be disposed on the charge-transporting layer. In such a case, the surface layer of the electrophotographic photosensitive member is the protective layer.

The protective layer can be formed by applying an application solution for protective layer prepared by dispersing a resin and optionally a charge-transporting material in a solvent and then drying it.

In the present invention, in the case where the protective layer is the surface layer, the protective layer contains the polyarylate resin and the acicular inorganic fillers and may optionally another resin as described above. The resin that is optionally mixed is the same as those described above.

The charge-transporting material contained in the protective layer can be the same material as that contained in the charge-transporting layer.

Examples of the solvent used in the application solution for the protective layer include alcohol solvents, sulfoxide solvents, ketone solvents, ether solvents, ester solvents, and aromatic hydrocarbon solvents.

The protective layer can have a thickness of 0.1 to 10 micrometers. The protective layer can optionally contain various additives such as a leveling agent, a dispersant, an antioxidant, an ultraviolet absorber, or a plasticizer.

The application of the application solution for each layer can be performed by an application method such as dip coating (dip application), spray coating, spinner coating, roller coating, Meyer bar coating, or blade coating.

Electrophotographic Apparatus

FIG. 1 schematically shows an example of the structure of an electrophotographic apparatus having a process cartridge including an electrophotographic photosensitive member according to an aspect of the present invention.

In FIG. 1, an electrophotographic photosensitive member 1 is cylindrical and rotates at a predetermined peripheral velocity in the direction of the arrow with a shaft 2 as a rotation center. The surface of the electrophotographic photosensitive member 1 is uniformly charged to a predetermined negative potential with a charging device (primary charging device: e.g., charging roller) 3 during the rotation process. Subsequently, the surface receives intensity-modulated exposure light (image exposure light) 4 corresponding to time-series electric digital image signals of objective image information output from an exposing device (not shown) such as a slit exposing device or a laser beam scanning exposing device. Thus, an electrostatic latent image corresponding to the objective image is successively formed on the surface of the electrophotographic photosensitive member 1.

The electrostatic latent image formed on the surface of the electrophotographic photosensitive member 1 is subjected to reversal development with a toner contained in a developer of a developing device 5 to form a toner image. Subsequently, the toner image formed and carried by the surface of the electrophotographic photosensitive member 1 is successively transferred to a transfer material (e.g., paper) P by a transfer bias from a transferring device (e.g., a transfer roller) 6. The transfer material P is taken out from a transfer material supplying device (not shown) in synchronization with rotation of the electrophotographic photosensitive member 1 and is fed between the electrophotographic photosensitive member 1 and the transferring device 6 (contact portion). The transferring device 6 is applied with a bias voltage having the polarity reverse to that of the toner by a bias power source (not shown).

The transfer material P to which the toner image has been transferred is separated from the surface of the electrophotographic photosensitive member 1 and is sent in a fixing device 8 to receive toner-image-fixing treatment and then conveyed to the outside of the apparatus as an image-formed product (print, copy).

The surface of the electrophotographic photosensitive member 1 after the toner image transfer is subjected to removal of post-transfer residual developer (post-transfer residual toner) with a cleaning device 7 to be cleared into a cleaned surface. Subsequently, the surface is subjected to neutralization treatment by pre-exposure light (not shown) from a pre-light exposing device (not shown), and then used again for image formation. If the charging device 3 is a contact charging device such as a charging roller as shown in FIG. 1, the pre-exposure is not necessarily required. In the present invention, the cleaning device can be a cleaning blade. The blade can contain a urethane resin.

In the present invention, two or more selected from the structural components, such as the electrophotographic photosensitive member 1, the charging device 3, the developing device 5, the transferring device 6, and the cleaning device 7, may be integrally supported in a container as a process cartridge. This process cartridge may be detachably attachable to the main body of an electrophotographic apparatus such as a copier or a laser beam printer. In FIG. 1, the electrophotographic photosensitive member 1, the charging device 3, the developing device 5, and the cleaning device 7 are integrally supported to constitute a process cartridge 9 that is detachably attachable to the main body of the electrophotographic apparatus with a guiding device 10 such as rails of the main body of the electrophotographic apparatus.

The present invention will be described in detail by Examples and Comparative Examples, but is not limited thereto. Note that "part(s)" in Examples and Comparative Examples means "part(s) by mass".

Example 1

An aluminum cylinder having a diameter of 30 mm and a length of 260 mm was used as a support. An application solution for electrically conductive layer was prepared by dispersing 10 parts of $SnO_2$-coated barium sulfate (electrically conductive pigment), 2 parts of titanium oxide (resistance-adjusting resin), 6 parts of a phenol resin (binder resin), and 0.001 parts of silicone oil (leveling agent) in a solvent mixture of 4 parts of methanol and 16 parts of methoxypropanol. This application solution for electrically conductive layer was applied onto the aluminum cylinder by dipping and was then heated at 140 degrees Celsius for 30 min for hardening to form an electrically conductive layer having a thickness of 15 micrometers.

Subsequently, an application solution for intermediate layer was prepared by dissolving 3 parts of N-methoxymethylated nylon and 3 parts of copolymerized nylon in a solvent mixture of 65 parts of methanol and 30 parts of n-butanol. This application solution for intermediate layer was applied onto the electrically conductive layer by dipping and was then dried at 100 degrees Celsius for 30 min to form an intermediate layer having a thickness of 0.5 micrometers.

Hydroxygallium phthalocyanine crystals (charge-generating material) having a crystal form exhibiting a strong peak at a Bragg angle (2 theta plus or minus 0.2 degrees) of 28.1 degrees in the CuK alpha characteristic X-ray diffraction were prepared. Three parts of the hydroxygallium phthalocyanine crystals, 2 parts of a polyvinyl butyral resin (trade name: S-Lek BX-1, manufactured by Sekisui Chemical Co., Ltd.), and 100 parts of cyclohexanone were mixed and subjected to dispersion treatment with a sand mill using glass beads of 1 mm diameter for 1 hr. One hundred parts of methyl ethyl ketone were added to the resulting dispersion to prepare an application solution for charge-generating layer. This application solution for charge-generating layer was applied onto the intermediate layer by dipping and was dried at 90 degrees Celsius for 10 min to form a charge-generating layer having a thickness of 0.15 micrometers.

Subsequently, an application solution for charge-transporting layer was prepared by dispersing 36.8 parts of a polyarylate resin (weight-average molecular weight: 128000) having a repeating structural unit represented by the above-mentioned Formula (1-2), 33.1 parts of a charge-transporting material represented by the following Formula (2), and 15 parts of basic magnesium sulfate fillers (trade name: MOS-HIGE, manufactured by Ube Industries, Ltd., Mohs hardness: 2.5) in 400 parts of chlorobenzene as shown in Table 1. This application solution for charge-transporting layer was applied onto the charge-generating layer by dipping and was dried at 120 degrees Celsius for 2 hr to form a charge-transporting layer having a thickness of 20 micrometers. The content of the acicular inorganic fillers in the resulting charge-transporting layer was 10% by volume (17.7% by mass based on the total mass of the charge-transporting layer) based on the total volume of the charge-transporting layer at 27 degrees Celsius and under one atmospheric pressure. The basic magnesium sulfate fillers have a specific gravity of 2.3 g/cm$^3$ and a number-average aspect ratio of 16. Thus, an electrophotographic photosensitive member having a charge-transporting layer as the surface layer containing a polyarylate resin and acicular inorganic fillers was produced.

[Chem. 3]

Formula (2)

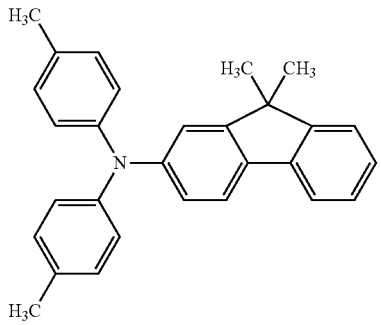

Example 2

An electrophotographic photosensitive member was produced as in Example 1 except that the acicular inorganic fillers contained in the application solution for charge-transporting layer was changed to titanium acid potassium fillers (trade name: Tismo D, manufactured by Otsuka Chemical Co., Ltd., Mohs hardness: 4) as shown in Table 1 to form the surface layer (charge-transporting layer). The content of the acicular inorganic fillers in the resulting charge-transporting layer was 10% by volume (24.5% by mass based on the total mass of the charge-transporting layer) based on the total volume of the charge-transporting layer at 27 degrees Celsius and under one atmospheric pressure. The titanium acid potassium fillers have a specific gravity of 3.5 g/cm$^3$ and a number-average aspect ratio of 19.

Example 3

An electrophotographic photosensitive member was produced as in Example 1 except that the acicular inorganic fillers contained in the application solution for charge-transporting layer was changed to natural calcium silicate fillers (trade name: Wollastonite 4W, manufactured by Tomoe Engineering Co., Ltd., Mohs hardness: 4.5) as shown in Table 1 to form the surface layer (charge-transporting layer). The content of the acicular inorganic fillers in the resulting charge-transporting layer was 10% by volume (21.2% by mass based on the total mass of the charge-transporting layer) based on the total volume of the charge-transporting layer at 27 degrees Celsius and under one atmospheric pressure. The natural calcium silicate fillers have a specific gravity of 2.9 g/cm$^3$ and a number-average aspect ratio of 6.

Example 4

An electrophotographic photosensitive member was produced as in Example 1 except that the acicular inorganic fillers contained in the application solution for charge-transporting layer was changed to basic magnesium sulfate fillers as shown in Table 1 to form the surface layer (charge-transporting layer). The content of the acicular inorganic fillers in the resulting charge-transporting layer was 1% by volume (1.9% by mass based on the total mass of the charge-transporting layer) based on the total volume of the charge-transporting layer at 27 degrees Celsius and under one atmospheric pressure.

Comparative Example 1

An electrophotographic photosensitive member was produced as in Example 1 except that the surface layer (charge-transporting layer) did not contain any acicular inorganic fillers.

Comparative Example 2

An electrophotographic photosensitive member was produced as in Example 1 except that the surface layer (charge-transporting layer) did not contain any acicular inorganic fillers and that the binder resin was changed to a polycarbonate resin (trade name: Iupilon 2200, manufactured by Mitsubishi Gas Chemical Company, Inc.) having a repeating structural unit represented by the following Formula (3):

[Chem. 4]

Formula (3)

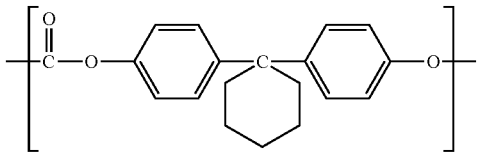

Comparative Example 3

An electrophotographic photosensitive member was produced as in Example 1 except that the acicular inorganic fillers contained in the application solution for charge-transporting layer was changed to a rutile-type titanium oxide (manufactured by Ishihara Sangyo Kaisha, Ltd., Mohs hardness: 7) as shown in Table 1 to form the surface layer (charge-transporting layer). The content of the acicular inorganic fillers in the resulting charge-transporting layer was 10% by volume (28.3% by mass based on the total mass of the charge-transporting layer) based on the total volume of the charge-transporting layer at 27 degrees Celsius and under one atmospheric pressure. The rutile-type titanium oxide has a specific gravity of 4.27 g/cm$^3$ and a number-average aspect ratio of 11.

Comparative Example 4

An electrophotographic photosensitive member was produced as in Example 1 except that the fillers contained in the application solution for charge-transporting layer were changed to silica particles having a diameter of 5.0 micrometers (trade name: Hipresica, manufactured by Ube Nitto Kasei Co., Ltd., Mohs hardness: 7) as shown in Table 1 to form the surface layer (charge-transporting layer). The content of the fillers in the resulting charge-transporting layer was 10% by volume (16.9% by mass based on the total mass of the charge-transporting layer) based on the total volume of the charge-transporting layer at 27 degrees Celsius and under one atmospheric pressure. The silica particles have a specific gravity of 2.2 g/cm$^3$ and a number-average aspect ratio of 1.

Comparative Example 5

An electrophotographic photosensitive member was produced as in Example 1 except that the fillers contained in the application solution for charge-transporting layer were changed to alumina particles having a diameter of 5.0 micrometers (manufactured by Nippon Light Metal Company, Ltd., Mohs hardness: 9) as shown in Table 1 to form the surface layer (charge-transporting layer). The content of the fillers in the resulting charge-transporting layer was 10% by volume (27% by mass based on the total mass of the charge-transporting layer) based on the total volume of the charge-transporting layer at 27 degrees Celsius and under one atmospheric pressure. The alumina particles have a specific gravity of 4.0 g/cm$^3$ and a number-average aspect ratio of 1.

Comparative Example 6

An electrophotographic photosensitive member was produced as in Example 1 except that the binder resin contained in the surface layer (charge-transporting layer) was changed to a polycarbonate resin having a repeating structural unit represented by Formula (3).

Comparative Example 7

An electrophotographic photosensitive member was produced as in Example 3 except that the binder resin contained in the surface layer (charge-transporting layer) was changed to a polycarbonate resin having a repeating structural unit represented by Formula (3).

TABLE 1

| | | Content (part by mass) | | | |
|---|---|---|---|---|---|
| | Type of filler | Resin | Charge-transporting material | Filler | Chloro-benzene |
| Example 1 | Basic magnesium sulfate | 36.8 | 33.1 | 15 | 400 |
| Example 2 | Potassium titanate | 33.8 | 30.4 | 20.8 | 400 |
| Example 3 | Natural calcium silicate | 35.3 | 31.8 | 18 | 400 |
| Example 4 | Basic magnesium sulfate | 43.9 | 39.5 | 1.6 | 400 |
| Comparative Example 3 | Titanium oxide | 32.1 | 28.9 | 24.1 | 400 |
| Comparative Example 4 | Silica | 37.3 | 33.5 | 14.4 | 400 |
| Comparative Example 5 | Alumina | 32.7 | 29.4 | 23 | 400 |
| Comparative Example 6 | Basic magnesium sulfate | 36.8 | 33.1 | 15 | 400 |
| Comparative Example 7 | Natural calcium silicate | 35.3 | 31.8 | 18 | 400 |

Evaluation

The electrophotographic photosensitive members of Examples 1 to 4 and Comparative Examples 1 to 7 were evaluated as follows. In the evaluation, a LaserJet 8100 laser beam printer (process speed: 32 ppm) manufactured by Hewlett-Packard Company was used. Table 2 shows the evaluation results of the electrophotographic photosensitive members in Examples and Comparative Examples.

pH of Filler

The pH of fillers was measured as described above: Five grams of fillers were dispersed in 100 mL of water, followed by boiling for 5 min. This dispersion was cooled to room temperature and was left to stand for 10 min. The pH of the supernatant of the dispersion was measured with a pH meter (trade name: Compact pH Meter Twin pH, manufactured by Horiba Ltd.). Table 2 shows the measured pH values. In the present invention, the term "basic fillers" refers to that the pH of a dispersion of the fillers is 8.0 or more. Incidentally, in acid fillers, the pH is 1.0 or more and less than 6.0; and in neutral fillers, the pH is 6.0 or more and less than 8.0.

Evaluation of Image Deletion

Image deletion was evaluated as follows: The electrophotographic photosensitive member produced above was mounted on a process cartridge for cyan of the above-mentioned apparatus, LaserJet 8100 laser beam printer, for evaluation, and the process cartridge was set to the station of the LaserJet 8100 laser beam printer. The primary charge voltage and the laser light quantity were adjusted so that the electrophotographic photosensitive member has an initial dark potential (Vd) of −650 V and an initial light potential (Vl) of −155 V at 22 degrees Celsius and a relative humidity of 55%. In the measurement of the surface potential of an electrophotographic photosensitive member, the cartridge was modified, a potential probe (model 6000B-8, manufactured by Trek Japan Co., Ltd.) was set to the developing position, and the potential at the central part of a drum was measured using a surface potentiometer (model 344, manufactured by Trek Japan Co., Ltd.). Subsequently, durability against initial continuous feeding of 1000 sheets of a half-tone image of a one dot knight jump pattern was investigated. Then, the Vd and the Vl at 32.5 degrees Celsius and a relative humidity of 85% were set to −650 V and −155 V, respectively, and initial continuous feeding of 10000 sheets of a half-tone image of a one dot knight jump pattern was performed. Images after the continuous feeding of 1000 sheets and continuous feeding of 10000 sheets were evaluated. The image evaluation was performed by measuring a half-tone image of a one dot knight jump pattern after the continuous feeding of 1000 sheets or 10000 sheets with a spectral densitometer (X-Rite 504/508, manufactured by X-Rite Co., Ltd.). The image density of a half-tone image of a one dot knight jump pattern on the initially fed sheet was 0.30 at 22 degrees Celsius and a relative humidity of 55%. The evaluation was performed by the following criteria. The results are shown in Table 2. In the present invention, A and B in the following evaluation criteria are levels where the effect of the present invention is achieved. In particular, A is a level to be judged excellent. C and D are levels where the effect of the present invention is not achieved. The criteria are as follows:

A: half-tone image density is 0.29 or more,

B: half-tone image density is 0.27 or more and less than 0.29,

C: half-tone image density is 0.25 or more and less than 0.27, and

D: half-tone image density is less than 0.25.

Measurement of Coefficient of Dynamic Friction

Figure 3:
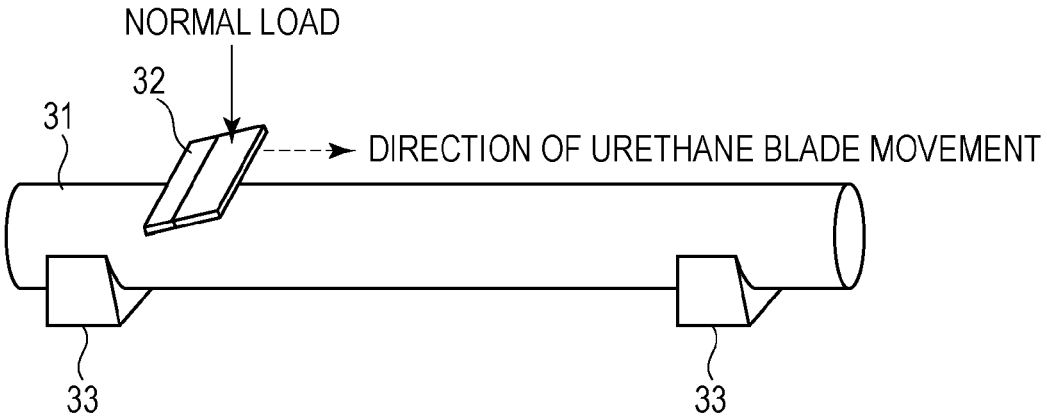
FIG. 3 is a diagram for describing a method of measuring coefficient of dynamic friction in Examples of the present invention.

The measurement of coefficient of dynamic friction was performed by measuring a change in coefficient of dynamic friction between a urethane blade having a JIS-A hardness of 70 degrees and an electrophotographic photosensitive member. The electrophotographic photosensitive member used in the evaluation of the image deletion was taken out from the printer after the initial continuous feeding of 1000 sheets and continuous feeding of 10000 sheets. A urethane blade was set to be in contact with the electrophotographic photosensitive member at an abutment angle of 26 degrees and an abutment load of 30 g with respect to the electrophotographic photosensitive member as shown FIG. 3, and the coefficient of friction was measured with a surface property tester Type 14FW (manufactured by Shinto Scientific Co., Ltd.) (normal load: 30 g, rubbing speed: 100 mm/min). In FIG. 3, reference numeral 31 denotes an electrophotographic photosensitive member, reference numeral 32 denotes a urethane blade, and reference numeral 33 denotes a catch for the electrophotographic photosensitive member. The coefficient of friction of the electrophotographic photosensitive member before being used in feeding was measured as in above. The resulting coefficient of friction was defined as 1, and the coefficient of friction of the photosensitive member used for continuous feeding of 1000 sheets or continuous feeding of 10000 sheets was calculated for evaluation. The evaluation was performed by the following criteria. The results are shown in Table 2. In the present invention, A and B in the following evaluation criteria are levels where the effect of the present invention is achieved. In particular, A is a level to be judged excellent. C and D are levels where the effect of the present invention is not achieved. The criteria are as follows:

A: coefficient of friction after being used in feeding is less than 1.2,

B: coefficient of friction after being used in feeding is 1.2 or more and less than 1.4, C: coefficient of friction after being used in feeding is 1.4 or more and less than 1.8, and D: coefficient of friction after being used in feeding is 1.8 or more.

TABLE 2

| | | Filler conditions | | | Coefficient of friction | | Image deletion | |
|---|---|---|---|---|---|---|---|---|
| | Type of filler | pH | Content (% by vol) | Aspect ratio | Feeding of 1000 sheets | Feeding of 10000 sheets | Feeding of 1000 sheets | Feeding of 10000 sheets |
| Example 1 | Basic magnesium sulfate | 10.5 | 10 | 16 | A | A | A | A |
| Example 2 | Potassium titanate | 9.9 | 10 | 19 | A | B | A | B |
| Example 3 | Natural calcium silicate | 9.8 | 10 | 6 | A | A | A | A |
| Example 4 | Basic magnesium sulfate | 10.5 | 1 | 16 | A | B | A | B |
| Comparative Example 1 | None | — | — | — | C | D | C | D |
| Comparative Example 2 | None | — | — | — | A | B | B | C |
| Comparative Example 3 | Titanium oxide | 3.3 | 10 | 11 | A | B | B | C |
| Comparative Example 4 | Silica | 7.3 | 10 | 1 | B | C | C | D |
| Comparative Example 5 | Alumina | 8.5 | 10 | 1 | B | C | B | C |
| Comparative Example 6 | Basic magnesium sulfate | 10.5 | 10 | 16 | A | B | B | C |
| Comparative Example 7 | Natural calcium silicate | 9.8 | 10 | 6 | A | B | A | C |

In order to investigate maintenance of the uneven shape of an electrophotographic photosensitive member surface due to the shape of fillers, the surface roughness was measured before and after electric discharge scratching with a surface roughness tester Surftest (trade name: SJ-210, manufactured by Mitutoyo Corporation). The electrophotographic photosensitive members in Example 1 and Comparative Example 4 were evaluated for Rz, which the maximum height in a roughness curve defined in JIS B 0601-2001, before and after the continuous feeding of 10000 sheets. The surface roughness Rz of the electrophotographic photosensitive member in each of Example 1 and Comparative Example 4 after continuous feeding of 10000 sheets was compared with that before the continuous feeding. In the electrophotographic photosensitive member of Example 1, the surface roughness Rz hardly changed after the feeding and was maintained to be 1.5 micrometers. In the electrophotographic photosensitive member of Comparative Example 4, the surface roughness Rz decreased by 0.7 micrometers after the feeding. This suggests that fillers having a high aspect ratio as in the present invention hardly desorb to maintain the uneven shape of the photosensitive member surface.

As shown in Comparative Example 1, in the case where the polyarylate resin does not contain any acicular inorganic fillers, the discharge products are not neutralized. Consequently, the effects of preventing an increase in coefficient of friction and of preventing image deletion after the continuous feeding of 1000 sheets and after the continuous 10000 sheets are insufficient. As shown in Comparative Example 2, though these effects are improved by using a polycarbonate resin, the effect of preventing image deletion is insufficient after continuous feeding of 10000 sheets.

As shown in Comparative Example 3, even if the aspect ratio is high, in acicular inorganic fillers having a high Mohs hardness and being acid, the effect of preventing image deletion is insufficient after continuous feeding of 1000 sheets and after continuous feeding of 10000 sheets. As shown in Comparative Examples 4 and 5, in fillers having an aspect ratio of approximately 1, effects of reducing the friction force during feeding sheets and of preventing image deletion are insufficient.

As shown in Comparative Examples 6 and 7, even if acicular inorganic fillers being basic and having a high aspect ratio are contained in the surface layer, in the case where the thermoplastic resin is a polycarbonate resin, the effect of preventing image deletion is insufficient after continuous feeding of 10000 sheets. These results described above show that, in order to obtain both effects of preventing image deletion and of reducing the friction force of a photosensitive member, as shown in Examples 1 to 4, it is necessary that the surface layer contains acicular inorganic fillers being basic and having a high aspect ratio and also contains a polyarylate resin.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-099696, filed Apr. 27, 2011 and Japanese Patent Application No. 2012-094051, filed Apr. 17, 2012, which are hereby incorporated by reference herein in their entirety.

The invention claimed is:

1. An electrophotographic photosensitive member, comprising:

an electrically conductive support; and a photosensitive layer formed on the electrically conductive support, wherein the electrophotographic photosensitive member has a surface layer comprising a thermoplastic resin and acicular inorganic fillers, wherein the thermoplastic resin is a polyarylate resin; and the acicular inorganic fillers are basic and have a number-average aspect ratio of 5 to 50;

each of the acicular inorganic fillers has Mohs hardness of 2 to 6; and each of the acicular inorganic fillers comprises a compound represented by the following Formula (A) or a compound represented by the following Formula (B), $$MgSO_4 \cdot 0.5Mg(OH)_2 \cdot 3H_2O \quad (A)$$

$$CaOSiO_2 \quad (B).$$

2. An electrophotographic photosensitive member according to claim 1, wherein the polyarylate resin comprises a repeating structural unit represented by the following Formula (1):

[Chem. 1]

Formula (1)

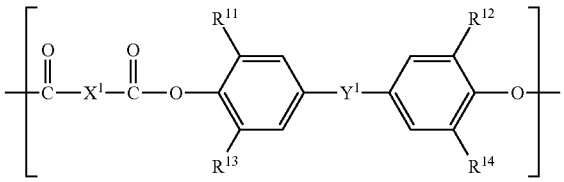

wherein, $R^{11}$ to $R^{14}$ each independently represent a hydrogen atom or a methyl group;

$X^1$ represents a meta-phenylene group, a para-phenylene group, or a bivalent group having two para-phenylene groups bonded with an oxygen atom; and $Y^1$ represents a single bond, a methylene group, an ethylidene group, a propylidene group, a cyclohexylidene group, or an oxygen atom.

3. A process cartridge detachably attachable to a main body of an electrophotographic apparatus, wherein the process cartridge integrally supports the electrophotographic photosensitive member according to claim 1 and a cleaning device.

4. A process cartridge according to claim 3, wherein the cleaning device comprises a cleaning blade.

5. An electrophotographic apparatus, comprising:

the electrophotographic photosensitive member according to claim 1;

a charging device;

an exposing device;

a developing device;

a transferring device; and a cleaning device.

6. An electrophotographic apparatus according to claim 5, wherein the cleaning device comprises a cleaning blade.

* * * * *